US006644885B2

(12) United States Patent
Dam-Rasmussen

(10) Patent No.: US 6,644,885 B2
(45) Date of Patent: Nov. 11, 2003

(54) IMPLEMENT COUPLING FOR LOADING MACHINE

(75) Inventor: Kaj Dam-Rasmussen, Højbjerg (DK)

(73) Assignee: Viby Jern Danmark A/S, Viby J (DK)

( * ) Notice: Subject to any disclaimer, the term of this patent is extended or adjusted under 35 U.S.C. 154(b) by 0 days.

(21) Appl. No.: 10/079,406

(22) Filed: Feb. 22, 2002

(65) Prior Publication Data

US 2002/0119001 A1 Aug. 29, 2002

(30) Foreign Application Priority Data

Feb. 23, 2001 (DK) ..... 2001 00308

(51) Int. Cl.[7] ..... E02F 3/96

(52) U.S. Cl. ..... 403/322.3; 403/322.1; 403/325; 403/326; 403/328; 414/723; 37/468

(58) Field of Search ..... 172/817, 245; 414/723; 403/321, 322.1, 322.3, 322.4, 323–328; 37/468, 403, 231, 407

(56) References Cited

U.S. PATENT DOCUMENTS

| | | | | |
|---|---|---|---|---|
| 3,964,622 A | * | 6/1976 | Blair et al. | 214/145 A |
| 4,881,867 A | | 11/1989 | Essex et al. | |
| 5,179,794 A | | 1/1993 | Ballinger | |
| 5,324,162 A | * | 6/1994 | Kishi | 414/723 |
| 5,642,785 A | | 7/1997 | Dam-Rasmussen | |
| 6,132,130 A | * | 10/2000 | McCann | 403/322 |
| 6,233,852 B1 | * | 5/2001 | Pemberton | 37/468 |
| 6,379,075 B1 | * | 4/2002 | Shamblin et al. | 403/322.1 |
| 6,481,124 B1 | * | 11/2002 | Miller et al. | 37/468 |

FOREIGN PATENT DOCUMENTS

| | | |
|---|---|---|
| AU | 557890 | 3/1984 |
| DK | 170425 B1 | 4/1993 |
| EP | 769590 A2 | 4/1997 |
| GB | 2205299 A | 12/1988 |
| WO | 14342 | 3/2000 |

OTHER PUBLICATIONS

Danish Search Report.

* cited by examiner

*Primary Examiner*—Lynne H. Browne
*Assistant Examiner*—Michael P. Ferguson
(74) *Attorney, Agent, or Firm*—Antonelli, Terry, Stout & Kraus, LLP

(57) ABSTRACT

The invention is an implement coupling for a loading machine including a connection for mounting the implement coupling at an extreme end of a loading arm and for connection with an actuating arm of a hydraulic cylinder. The implement coupling comprises a coupling mechanism which couples the implement coupling with a complementary coupling mechanism of an implement, and a locking mechanism with a transverse, displaceable locking beam comprising a locking mechanism which interacts with the complementary coupling of the implement, and which may be displaced by spindles or hydraulic cylinders. The coupling mechanism includes an upper fixed hook coupling parts, which grip around upper connecting pins on the implement, and by lower, displacing hook coupling parts, which fix lower connecting pins of the implement when in contact with a contact surface on the implement coupling, the displacing coupling parts being connected with the locking beam.

2 Claims, 3 Drawing Sheets

IMPLEMENT COUPLING FOR LOADING MACHINE

BACKGROUND OF THE INVENTION

1. Field of the Invention

The present invention concerns an implement coupling for a loading machine.

2. Description of the Prior Art

Implement couplings for a digging or loading machine are used for the purpose of rapidly and easily changing between different implements, e.g. between loading buckets with different widths or different capacity. The implement coupling may include a manually operated changing mechanism requiring that the machine operator leaves the operator's cabin, or may comprise a remotely controlled changing mechanism that may be operated from the cabin and which, for example, may comprise a hydraulic cylinder.

SUMMARY OF THE INVENTION

The invention has the purpose to provide an implement coupling for a loading machine which by means of simple measures enables achieving good function and extraordinary safety against unintended release of the implement.

The implement coupling according to the invention is peculiar in that the coupling means are constituted by upper fixed hook coupling parts, which are arranged for gripping around upper connecting pins on the implement, and by lower, displacing hook coupling parts, which are arranged for fixing lower connecting pins of the implement when the lower connecting pins are in contact with a contact surface on the implement coupling, the displacing coupling parts being connected with the locking beam. By means of simple technical measures there is achieved good function of the implement coupling and extra safety against release of the implement caused by unintended deactivation of the locking function of the implement coupling. It is to be emphasized that the design of the complementary coupling of implement and implement coupling counteracts difficulties due to relatively often occurring variations in spacing between coupling parts of the implement coupling and connecting pins on the implement.

Suitably, the implement coupling according to the invention may comprise a pivot mechanism arranged to displace the locking beam via a connecting arm, wherein the pivot mechanism comprises an actuation member which is pivotably suspended in the implement coupling, and which is arranged to be pivoted by means of either a mechanical spindle or a hydraulic cylinder, and that the pivot mechanism furthermore is connected with a strong compression spring arranged to bias the locking beam towards a locking position thereof with a pressing action.

When the implement coupling according to the invention is adapted for manual operation, it may suitably include at least one mechanical spindle arranged to cause displacing of the locking beam, wherein the locking beam is also connected with a strong compression spring arranged to exert constant pressure on the locking beam so as to bias the beam towards its locking position.

When adapted for hydraulic operation, the implement coupling according to the invention may advantageously include at least one cylinder arranged to cause the displacing of the locking beam, wherein the locking beam furthermore is connected with at least one strong compression spring arranged to exert constant pressure on the locking beam so as to bias the locking beam towards its locking position.

The implement coupling according to the invention may furthermore advantageously be adapted to include a hydraulic cylinder disposed at the center of the implement coupling and arranged to cause the sliding of the locking beam.

Alternatively, the implement coupling according to the invention may furthermore include two hydraulic cylinders disposed at each their end of the implement coupling and arranged to cause the displacing of the locking beam.

Furthermore, the implement coupling according to the invention may be designed so that the contact surface of the implement coupling at the side facing the fixed hook coupling part is provided with a projection for facilitating temporary connection between implement coupling and implement until final locking engagement has occurred.

BRIEF DESCRIPTION OF THE DRAWINGS

The invention will now be explained in greater detail with reference to the drawings of which.

DESCRIPTION OF THE PREFERRED EMBODIMENTS OF THE INVENTION

Figure 1:
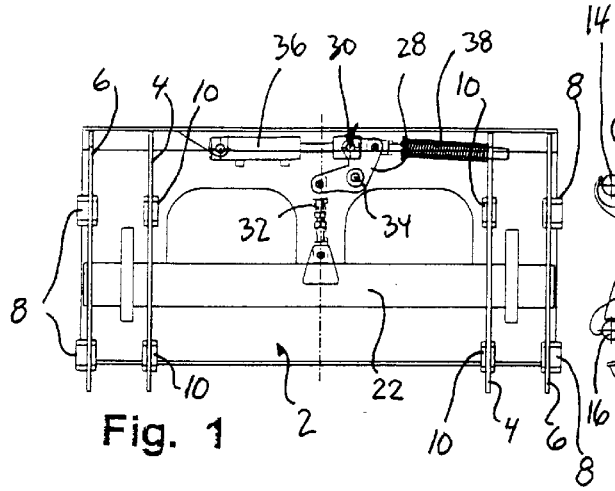
FIG. 1 shows a rear view of an embodiment of an implement coupling according to the invention with hydraulic pivoting mechanism.
Figure 2:
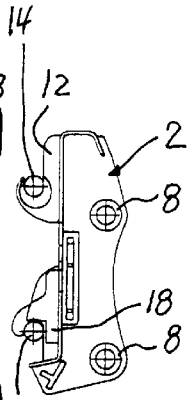
FIG. 2 shows a side view from the left of the implement coupling of FIG. 1 in locked condition
Figure 3:
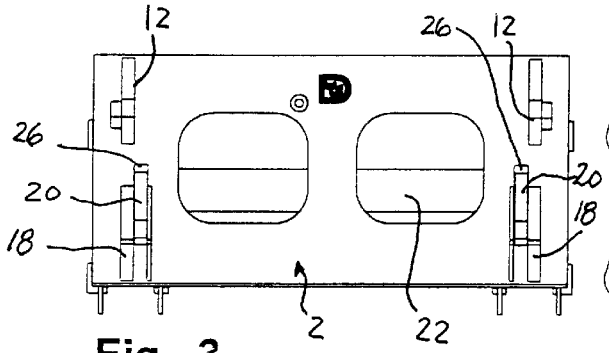
FIG. 3 shows a front view of the implement coupling of FIG. 1.
Figure 4:
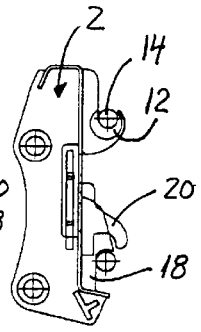
FIG. 4 shows a side view from the left of the implement coupling of FIG. 1 in the unlocked condition.
Figure 19:
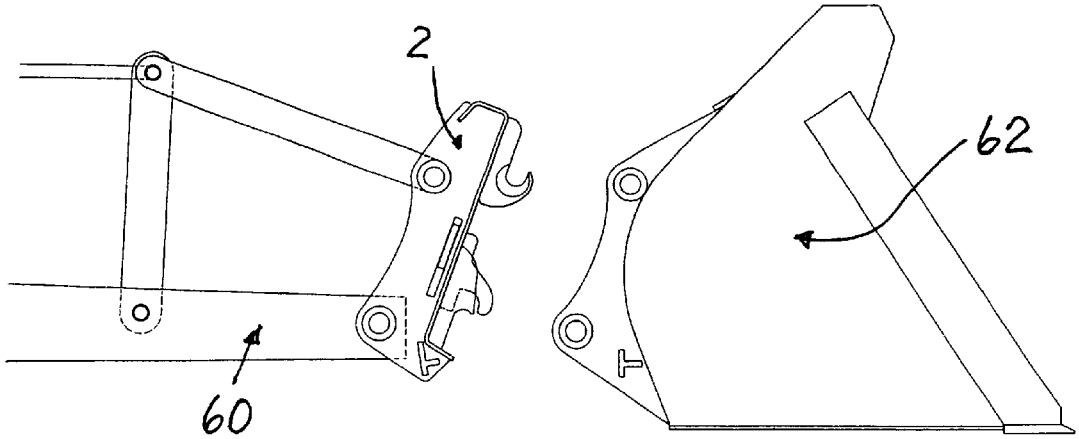
FIG. 19 shows a side view of the implement coupling according to the invention mounted at an extreme end of a loading arm before being connected with a loading bucket.

The implement coupling 2 shown in FIGS. 2–4 includes two pairs of parallel bearing plates 4 and 6 with bearing bushes 8 and 10 which serve in mounting the implement coupling 2 at the outer end of a loading arm 60 (FIG.19) and serve as a yoke for a hydraulic cylinder for pivoting the implement coupling and implement, respectively, e.g. a loading bucket 62 (FIG. 19).

At one side, the implement coupling 2 is provided with hook-shaped connecting parts 12 which grip around fixed connecting pins 14 at each side of the implement, e.g. a loading bucket 62 (FIG. 19) which is also provided at the opposite side with connecting pins 16 that are intended for contacting abutments 18 before hook-shaped locking members 20 at opposite ends of a transverse sliding locking beam 22 of the implement coupling 2 are displaced across the connecting pins 16 and fix the pins against the abutment. At the side facing the hook-shaped connecting parts 12, there are projections 24 with the purpose of facilitating fixation of the implement coupling 2 on the implement until the implement has been fastened by means of the hook-shaped locking members 20. Compared with previous implement couplings of this kind, which, instead of e.g. abutments 18 and hook-shaped locking members 20 of the invention, locking bushings and locking pins were provided. The implement coupling according to the invention is much easier to use because a certain variation is allowed in spacing between the hook-shaped locking members 20 and the abutments 18 without extra difficulty of establishing a remotely controlled locking engagement between the implement coupling and an implement, e.g. a loading bucket 62 (FIG. 19).

When the hook-shaped connecting parts 12 are brought into position around the connecting pins 14, and the connecting pins 16 are brought into position against the abutments 18, the hook-shaped locking members 20 are displaced across the connecting pins 16, as the locking members 20, which are welded on opposite ends of the locking beam 22, protrude through elongate apertures 26 of the implement coupling 2. This is connected with a pivoting arm 28 of a pivoting mechanism 30 at about the center of the implement coupling 2 by means of a longitudinally adjustable connecting arm 32.

The pivoting arm 28 is pivotably journalled on the implement coupling 2 about a pivot 34 in such a way that the pivoting arm 28 by pivoting action of a hydraulic cylinder 36 and against the action of a strong compression spring 38 inserted between pivoting arm 28 and one of the bearing plates of the implement coupling may displace the locking beam 22 and the hook-shaped locking members 20 connected therewith in direction away from the abutments 18, i.e. to unlocked condition. This arrangement with compression springs 38 ensures that locked condition can be maintained even though the hydraulic drive pressure disappears.

Figure 5:
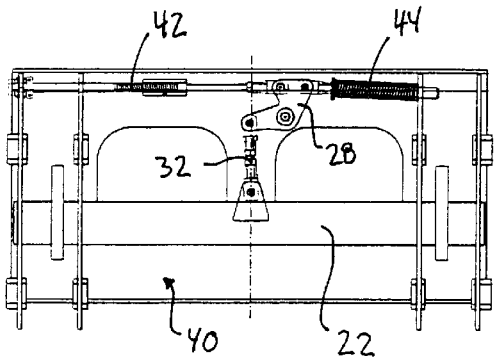
FIG. 5 shows a rear view of a second embodiment of an implement coupling according to the invention with a mechanical pivoting mechanism.
Figure 6:
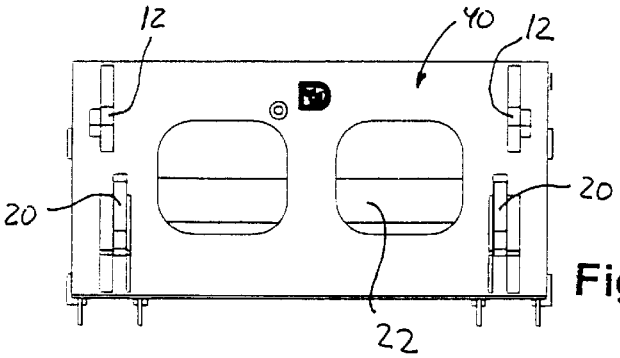
FIG. 6 shows a front view of the implement coupling of FIG. 5.
Figure 7:
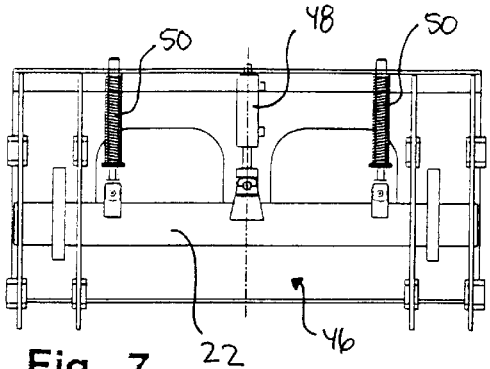
FIG. 7 shows a rear view of a third embodiment of an implement coupling according to the invention with a locking mechanism with one hydraulic cylinder.
Figure 8:
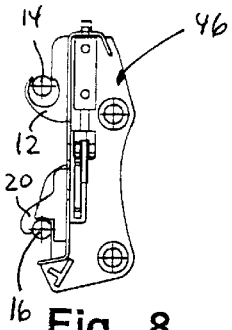
FIG. 8 shows a side view from the left of the implement coupling of FIG. 7 in locked condition.
Figure 9:
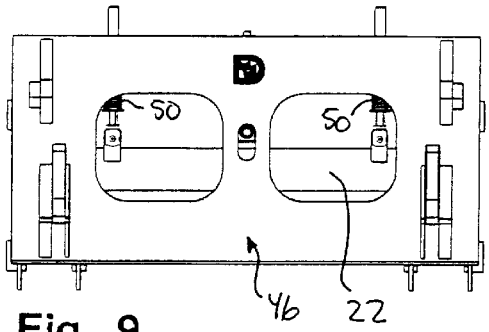
FIG. 9 shows a front view of the implement coupling of FIG. 7.
Figure 10:
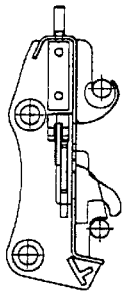
FIG. 10 shows a side view from the left of the implement coupling of FIG. 9 in unlocked condition.
Figure 11:
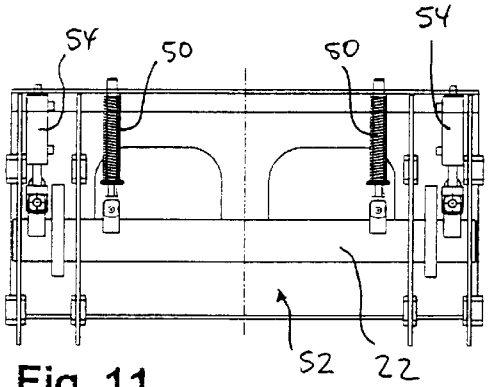
FIG. 11 shows a rear view of a fourth embodiment of an implement coupling according to the invention with a locking mechanism with two hydraulic cylinders.
Figure 12:
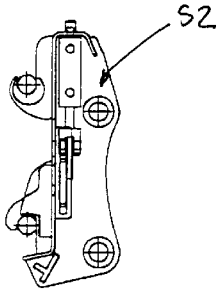
FIG. 12 shows a side view from the left of the implement coupling of FIG. 11 in locked condition.
Figure 13:
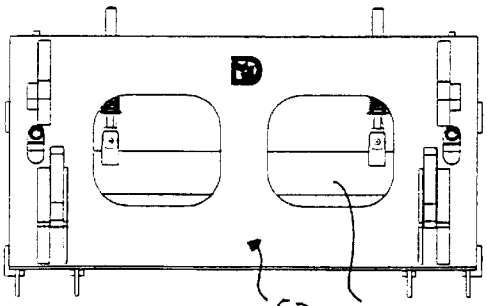
FIG. 13 shows a front view of the implement coupling of FIG. 11
Figure 14:
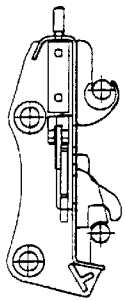
FIG. 14 shows a side view from the left of the implement coupling of FIG. 13 in unlocked condition.
Figure 15:
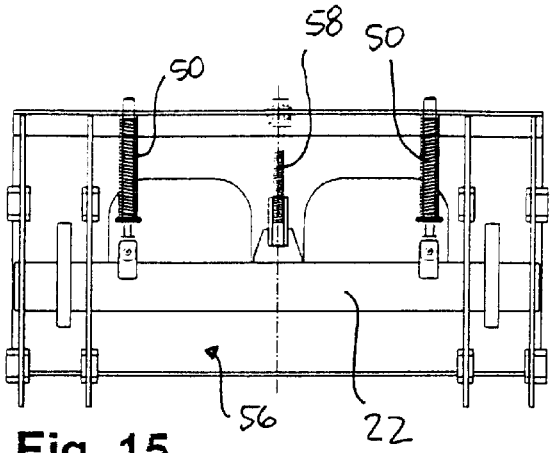
FIG. 15 shows a rear view of a fifth embodiment of an implement coupling according to the invention with one mechanical locking mechanism.
Figure 16:
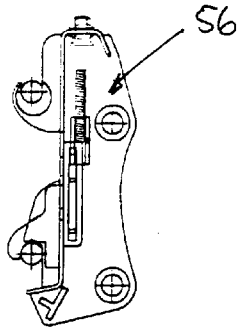
FIG. 16 shows a side view from the left of the implement coupling of FIG. 15 in locked condition.
Figure 17:
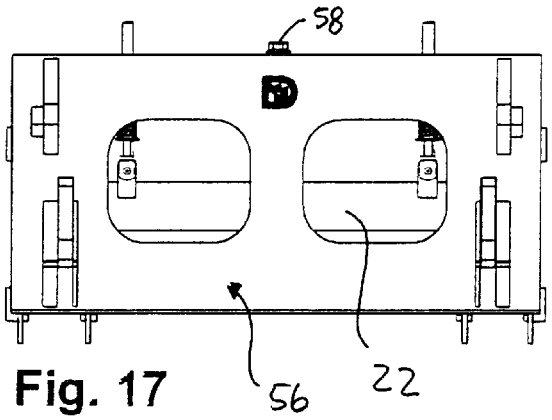
FIG. 17 shows a front view of the implement coupling of FIG. 15.
Figure 18:
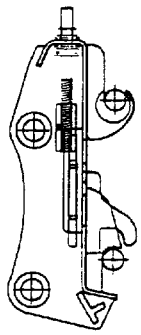
FIG. 18 shows a side view from the left of the implement coupling of FIG. 17 in unlocked condition.

In FIGS. 5 and 6 is shown another implement coupling 40 constructed like the implement coupling 2 but where the hydraulic cylinder is substituted by a manual spindle mechanism 42 which is able to release the locking engagement between implement coupling 40 and an implement against the action of a compression spring 44.

In FIGS. 7–10 is shown a third implement coupling 46 where the locking engagement between implement and implement coupling 46 is served by one central hydraulic cylinder 48 that can move against the action of two strong compression springs 50 at the withdrawal of the cylinder rod, which is connected with the locking beam and the hook-shaped locking members connected therewith so that the locking engagement between implement and implement coupling is cancelled.

In FIGS. 11–14 is shown a fourth implement coupling 52 where the locking engagement between implement and implement coupling 52 is served by means of two hydraulic cylinders 54 inserted between the implement coupling 52 and the locking beam 22.

In FIGS. 15–18 is shown a fifth implement coupling 56 where the locking engagement between implement and implement coupling 56 is served by means of one central spindle mechanism 58.

What is claimed is:

1. An implement coupling for a loading machine including a connection for mounting the implement coupling at an end of a loading arm and for connection with an actuating arm of a hydraulic cylinder, the implement coupling comprising:

a coupling mechanism which couples the implement coupling with a complementary coupling mechanism of an implement, and a locking mechanism with a transverse, displaceable locking beam which interacts with the complementary coupling of the implement, and which may be displaced by a spindle or at least one hydraulic cylinder;

at least one mechanical spindle which causes the displacing of the locking beam, and Wherein the locking beam is also connected with a compression spring which exerts constant pressure on the locking beam so as to bias the beam towards a locking position thereof; and wherein:

the coupling mechanism includes upper fixed hook coupling parts, which grip around upper connecting pins on the implement, and lower displacing hook coupling parts, which fix lower connecting pins of the implement when in contact with a contact surface on the implement coupling and the lower displacing coupling parts being connected with the displaceable locking beam and the upper fixed hook coupling parts and the lower displacing hook coupling parts opening respectively in upward and downward directions with the displaceable locking beam causing the lower displacing hook coupling parts to move downward to engage the lower connecting pins while the upper connecting pins engage the upper fixed hook coupling parts.

2. An implement coupling according to claim 1 wherein:

the contact surface of the implement coupling, at a side facing a fixed hook coupling part, includes a projection which facilitates a temporary connection between the implement coupling and the implement until a final locking engagement has occurred.

* * * * *